US008509386B2

(12) United States Patent
Lee et al.

(10) Patent No.: US 8,509,386 B2
(45) Date of Patent: Aug. 13, 2013

(54) X-RAY TARGET AND METHOD OF MAKING SAME

(75) Inventors: David S. K. Lee, Salt Lake City, UT (US); John E. Postman, Draper, UT (US)

(73) Assignee: Varian Medical Systems, Inc., Palo Alto, CA (US)

( * ) Notice: Subject to any disclaimer, the term of this patent is extended or adjusted under 35 U.S.C. 154(b) by 134 days.

(21) Appl. No.: 12/816,216

(22) Filed: Jun. 15, 2010

(65) Prior Publication Data

US 2011/0305324 A1 Dec. 15, 2011

(51) Int. Cl.
*H01J 35/10* (2006.01)
*H01J 35/08* (2006.01)

(52) U.S. Cl.
USPC ..... 378/144; 378/125; 378/143

(58) Field of Classification Search
USPC ..... 378/143, 144, 125
See application file for complete search history.

(56) References Cited

U.S. PATENT DOCUMENTS

| | | | | | |
|---|---|---|---|---|---|
| 3,801,847 | A | * | 4/1974 | Dietz | 378/125 |
| H547 | H | * | 11/1988 | Lux et al. | 378/144 |
| 5,178,316 | A | * | 1/1993 | Block | 228/124.1 |
| 5,414,748 | A | | 5/1995 | Upadhya | |
| 5,875,228 | A | | 2/1999 | Truszkowska | |
| 5,943,389 | A | | 8/1999 | Lee | |
| 6,002,745 | A | * | 12/1999 | Miller et al. | 378/128 |
| 6,132,812 | A | * | 10/2000 | Rodhammer et al. | 427/446 |
| 6,157,702 | A | * | 12/2000 | Reznikov et al. | 378/144 |
| 6,400,800 | B1 | * | 6/2002 | Warren | 378/144 |
| 7,194,066 | B2 | * | 3/2007 | Tiearney et al. | 378/143 |
| 7,601,399 | B2 | * | 10/2009 | Bamola et al. | 427/446 |
| 7,720,200 | B2 | * | 5/2010 | Steinlage et al. | 378/144 |
| 7,860,220 | B2 | * | 12/2010 | Aoyama et al. | 378/144 |
| 8,059,785 | B2 | * | 11/2011 | Lee et al. | 378/127 |
| 8,116,432 | B2 | * | 2/2012 | Steinlage et al. | 378/144 |
| 8,165,269 | B2 | * | 4/2012 | Lee et al. | 378/144 |
| 2010/0080358 | A1 | | 4/2010 | Lee et al. | |

OTHER PUBLICATIONS

International Search Report in related PCT application No. PCT/US2011/040387 mailed Feb. 9, 2012.

* cited by examiner

*Primary Examiner* — Allen C. Ho

(74) *Attorney, Agent, or Firm* — Maschoff Brennan

(57) ABSTRACT

In one example, an x-ray target comprises a target track, a substrate, and an optional backing. The target track includes a base material and a grain growth inhibitor to reduce or prevent microstructure grain growth in the base material. The target track can be included as part of an x-ray tube anode, either of a rotary form or a stationary form.

18 Claims, 2 Drawing Sheets

X-RAY TARGET AND METHOD OF MAKING SAME

BACKGROUND

1. Relevant Field

Embodiments of the present invention relate to x-ray tube targets. More particular, disclosed embodiments relate to targets, and methods of producing targets, having an improved target track for receiving electrons.

2. The Relevant Technology

X-ray devices of all types employ a cathode and an x-ray target, which serves as an anode. A voltage is connected across the cathode and the x-ray target to create a potential difference between the cathode and the x-ray target. Electrons emitted by the cathode are accelerated across the potential and collide with the x-ray target so as to produce x-rays.

The x-ray target must withstand high temperature operating conditions. The x-ray generation process causes the x-ray target to reach operating temperatures, which can be as high as several thousand degrees Celsius. The higher an x-ray device's radiation requirement, or x-ray power, the higher the operating temperature of the x-ray target. Thus, the x-ray target must be constructed from materials that can withstand x-ray generation operating temperatures.

Although all x-ray target materials experience high operating temperatures, the target track experiences the highest operating temperatures because it is the focal point of the x-ray generating process. In some high powered x-ray applications, the operating temperatures surpass the thermo-mechanical limitations of typical target track materials, and the target track can be damaged or even fail completely. Past attempts to overcome thermo-mechanical limitations of the target track include increasing the overall x-ray target size, or rotating the x-ray target at higher rates. These actions focus on spreading the generated heat over a larger surface area to increase heat dissipation.

Larger x-ray target designs and higher rotation rates lead to several undesirable x-ray device characteristics, including: heavier x-ray targets, bigger x-ray tube housings, larger gantries, and slower access time. Moreover, these characteristics pose reliability problems associated with material strength limitations and significantly increase the cost of high powered x-ray devices.

SUMMARY OF EXAMPLE EMBODIMENTS

In general, embodiments of the present invention are directed to x-ray targets, and methods for making the targets, that are used in connection with an anode assembly of an x-ray tube. The disclosed anode targets exhibit a number of advantages over the prior art. For example, x-ray targets described herein utilize a unique target track that is made from a material or combination of materials that can reliably operate at higher temperatures than conventional targets, and that can thus be used in high power x-ray applications. Moreover, disclosed target embodiments resist warping and dimensional changes of the track and substrate, thereby retaining vibration stability. In addition, a target track having a higher tensile strength is provided; also very desirable in the presence of high operating temperatures. Each of these improvements—as well as others—are achieved without having to resort to solutions of the prior art, such as increasing the overall x-ray target size, or rotating the x-ray target at higher rates. As such, disclosed targets not only exhibit increased reliability in the presence of high operating temperatures, but can do so while retaining a relatively smaller size. This results in a number of advantages: the targets use fewer materials, are lower in cost, and require a smaller space (allowing for smaller overall size of x-ray tube). Further, when used in a rotating anode environment the smaller targets are easier to rotate, and are easier to speed up to operational rotational speed.

In an example embodiment, an x-ray target comprises a target track and a substrate. In some embodiments, a backing is also included. The target track includes a base material and a grain growth inhibitor to reduce or prevent microstructure grain growth in the base material. The introduction of a grain growth inhibitor to the base material affects the microstructure of the base material by preventing excess grain growth during the various processes that the target track may undergo when manufacturing or producing the x-ray target. In addition, reducing excess grain growth in the base material results in a target track material that is able to better withstand high operating temperatures and a target track having a higher tensile strength.

If needed, the backing can be provided to, for example, draw heat away from the substrate. If a solid backing is utilized, certain embodiments might utilize a bond layer to attach the backing to the substrate. Depending on the composition of the backing, the bond layer might include one or more carbon management layers for reducing (or eliminating) carbon diffusion out of the backing and into the substrate.

In practice, disclosed embodiments of the target can be utilized in rotary anode x-ray tubes. Alternatively, targets utilizing these techniques can be implemented in stationary anode x-ray tubes.

In another embodiment, a method for producing an x-ray target is disclosed. The method includes, for example, the step of disposing a base material and a grain growth inhibitor material onto a substrate. Next, the base material and the grain growth inhibitor material are processed to form a target track and in a manner so as to increase the density of the target track. A backing can then be optionally attached to the substrate. The steps of disposing and processing can be performed using a variety of techniques. For example, in disclosed embodiments, the target track is disposed on the substrate using a Vacuum Plasma Spray (VPS) process, wherein feedstock powder of the base material(s) and the grain growth inhibitor are combined and prepared to contain a desired amount of each material. In certain embodiments, the feedstock powder can be pre-processed to obtain a specific particle size and any other desired characteristics. Other disposition techniques can also be used.

If a backing is attached, various attachment techniques can be used, including, for example, the use of a bond layer formed via a braze process. A carbon management layer may also be provided in connection with the bond layer depending, for example, on the composition of the backing.

This Summary is provided to introduce a selection of concepts in a simplified form that are further described below in the detailed description. This Summary is not intended to identify key features or essential characteristics of the claimed subject matter, nor is it intended to be used as an aid in determining the scope of the claimed subject matter. Moreover, it is to be understood that both the foregoing general description and the following detailed description of the present invention are exemplary and explanatory and are intended to provide further explanation of the invention as claimed.

BRIEF DESCRIPTION OF THE DRAWINGS

To clarify certain aspects of the present invention, a more particular description of the invention will be rendered by reference to specific embodiments thereof, which are illustrated in the appended drawings. It is appreciated that these drawings depict only typical embodiments of the invention and are therefore not to be considered limiting of its scope. The invention will be described and explained with additional specificity and detail through the use of the accompanying drawings.

DETAILED DESCRIPTION OF EXAMPLE EMBODIMENTS

Reference will now be made to the drawings to describe various aspects of some example embodiments of the invention. The drawings are only diagrammatic and schematic representations of such example embodiments and, accordingly, are not limiting of the scope of the present invention, nor are the drawings necessarily drawn to scale. Embodiments of the invention relate to x-ray devices, x-ray targets, and methods for making x-ray targets.

1. Example X-Ray Device

Figure 1:
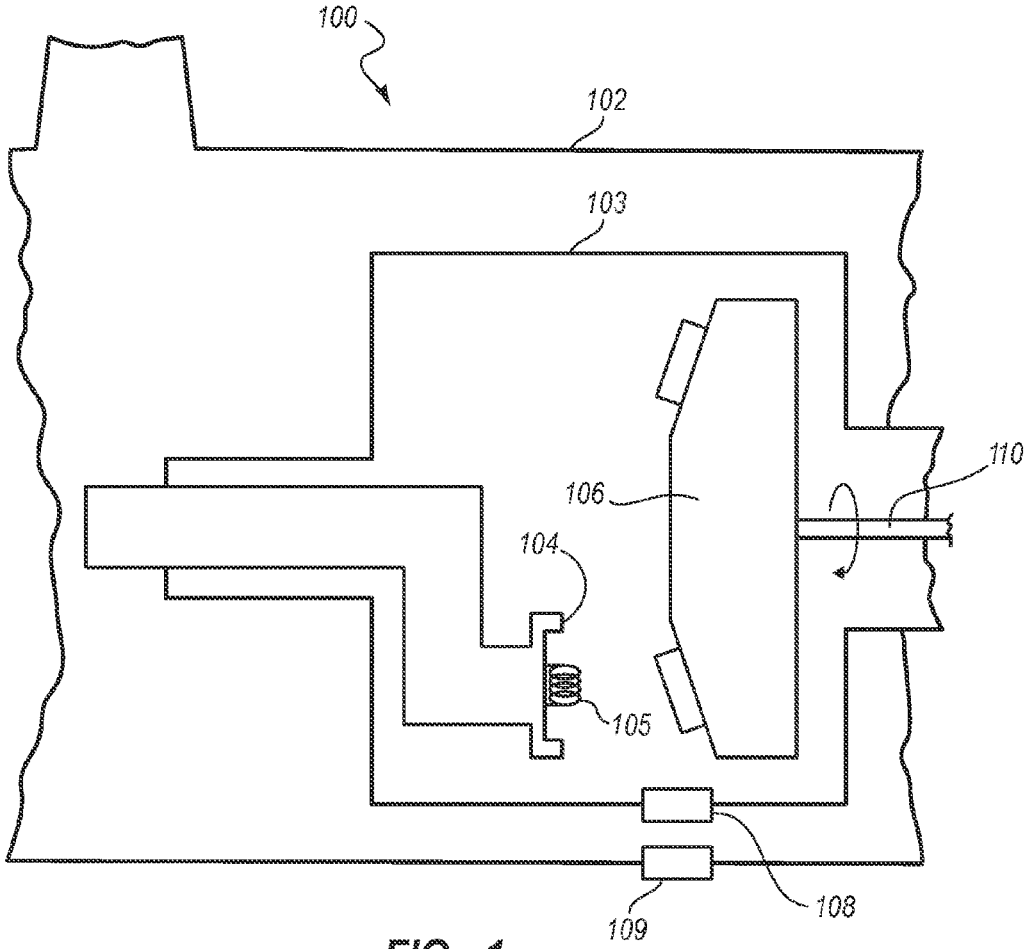
FIG. 1 illustrates a cross-sectional view of an example x-ray device.

Directing attention to FIG. 1, aspects of one example of an x-ray device 100 are disclosed. The x-ray device 100 has a housing 102 within which various components are disposed. The components within the housing 102 include an x-ray tube in the form of an evacuated enclosure 103 and within which is disposed a cathode 104 spaced apart from an x-ray target anode 106. An x-ray transmissive window 108 is provided in the evacuated enclosure 103 and is aligned with a x-ray transmissive port 109 provided in the outer housing 102. In the illustrated embodiment, the x-ray target anode 106 is rotatable and is connected to a rotatable shaft 110. It will be appreciated however that in other embodiments, the x-ray device 100 might utilize a stationary target anode.

In operation, a voltage is applied between the cathode 104 and the x-ray target anode 106 to create a potential difference between the cathode and the anode. A current is supplied to a filament 105, which causes the filament to heat and thereby result in the emission of electrons in a well known manner. The electrons are accelerated towards the anode due to the voltage potential between the cathode and the anode. When the electrons collide with the x-ray anode target 106, kinetic energy is generated, much of which is released as heat. However, some of the energy results in the production of x-rays in a manner that is well known. The anode and its target surface (described further below) are positioned such that resulting x-rays are passed through the window 108 and the port 109 and into an x-ray subject (not shown).

In a rotating anode target 106 configuration, the anode target 106 is connected to and rotatably supported by the shaft 110. The shaft 110 is connected to a drive mechanism (typically via bearings, rotor and an inductive motor arrangement, not shown) that rotates the shaft 110 and imparts a rotational motion to the x-ray target 106 during the x-ray generation process. In this way, the heat created by the x-ray generation process is distributed more evenly throughout the x-ray target 106. As noted above, in other embodiments, the anode target 106 may be stationary, and cooling is achieved in different ways, such as by a direct liquid cooling system (not shown).

The example x-ray device 100 can be configured for use in a variety of x-ray applications. Some example x-ray applications, in connection with embodiments of the invention, include, but are not limited to, medical, dental, industrial, and security or inspection. Of course, embodiments of the x-ray device 100 may be used in almost any x-ray application.

Different x-ray applications require varying amounts of x-ray power. In high power applications, e.g., CT applications, the operating power of the x-ray device 100 can be 100 kW and higher. Other embodiments of the x-ray device 100 may have more or less power as required by the specific application for which the x-ray device 100 is configured. Although embodiments of the x-ray device 100 may be used with various levels of x-ray power, the example x-ray device 100 is particularly adept to handling high x-ray power requirements.

Generally, the higher the x-ray power, the higher the operating temperature of the x-ray device 100. Higher operating temperatures might result in the need for a larger x-ray target, faster rotational rates of the x-ray target, or combinations of both. Embodiments of the x-ray device 100, however, incorporate an x-ray target 106 having a configuration that may withstand higher operational temperatures relative to typical x-ray targets. Thus, the x-ray target 106 may have a smaller overall size and a slower rotational rate compared to that of typical x-ray targets. For example, in the case of a high powered CT x-ray application, a typical x-ray device might have about a 240 mm diameter x-ray target that is rotated at a rate of about 9,000 rpm in order to withstand the operating temperature. In comparison, for the same amount of x-ray power, the x-ray device 100 incorporating the example x-ray target 106, having a configuration that may withstand higher operation temperatures, as described more fully below, may have about a 100-200 mm diameter x-ray target 106 that is rotated at a rate of about 6,000 rpm. Note that the foregoing dimensions are provided solely for purposes of illustration; other examples of an x-ray device 100 may have different x-ray target 106 sizes and rotation rates depending on the requirements of the specific x-ray device and proposed applications.

In general, reduction in the size and rotational speed of an x-ray target are advantageous for a number of reasons. Advantages include, but are not limited to, reduced target weight, opportunity for faster spin up to operational speed, reduced space requirements (reducing tube housing size, gantry size), lower material requirements, lower costs and increased reliability.

2. Example X-Ray Target and X-Ray Target Track

Figure 2:
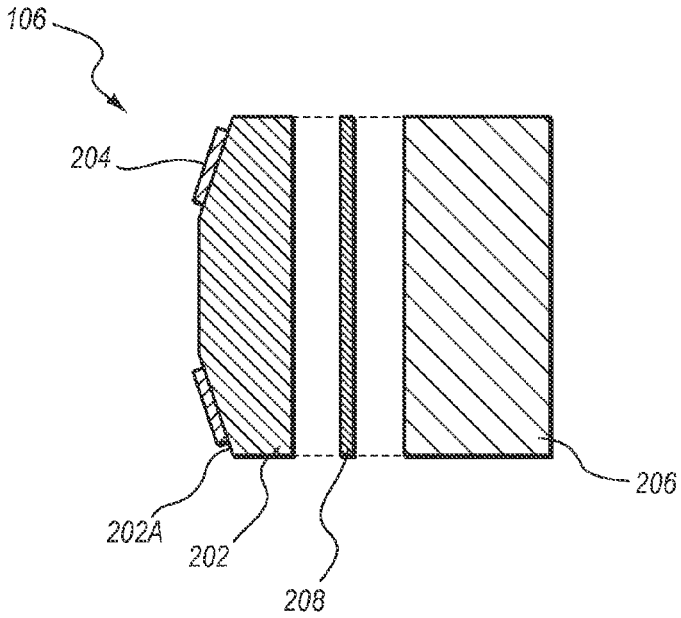
FIG. 2 illustrates a cross-sectional view of an example x-ray target.

FIG. 2 illustrates one example of an x-ray target, which is denoted generally at 106. The example x-ray target 106 includes a substrate 202, a target track 204 disposed on one side of the substrate 202, and an optional backing 206 disposed on the opposite side of the substrate 202. The backing 206 may be attached to the substrate 202 by way of a bond layer 208, for example.

In one operational example, the x-ray target 106 includes a target track 204 made from a material or combination of materials that can reliably operate at higher temperatures during the x-ray generation process relative to a target track not made from the same material(s). The target track 204 can reliably operate at higher temperatures (e.g., above about 1500 degrees Celsius), and yet still meet the x-ray generation requirements of various types of x-ray devices 100.

In the illustrated example, the target track 204 is made from a base material in combination with a grain growth inhibitor. The introduction of a grain growth inhibitor to the base material affects the microstructure of the base material by preventing excess grain growth during the various processes that the target track 204 may undergo when manufacturing or producing the x-ray target 106. Reducing excess grain growth in the base material results in a target track 204 material that is able to better withstand high operating temperatures relative to a target track material that lacks a grain growth inhibitor. For example, by reducing excess grain growth, the target retains its initial (pre-assembly) mechanical strength and resists warping and dimensional changes of the track and substrate, thereby retaining vibration stability. Vibration instability can lead to early bearing failure or increased noise, which can lead to the need for tube replacement. In addition, reducing or eliminating excessive grain growth results in a target track 204 having a higher tensile strength. This is very desirable, especially when exposed to high operating temperatures.

In one example, the base track material is a tungsten-rhenium alloy. The base track material may have various amounts of tungsten with respect to rhenium. In particular, in one embodiment the base track material may be made of about 90% tungsten and about 10% rhenium, by weight. In other embodiments, however, the amounts of tungsten and rhenium may vary. For example, other base track materials may be made from between about 85% to about 100% tungsten and about 15% to about 0% rhenium, by weight, respectively.

In addition to tungsten or various tungsten-rhenium alloys, other materials/alloys having similar characteristics might also be used. Any of a variety of high Z (atomic number) materials that produce x-rays when struck by electrons may be used, and any other suitable material(s) can likewise be employed in the construction of the target track 204.

In one example embodiment, the grain growth inhibitor used is a carbide material, such as hafnium carbide (HfC). Hafnium carbide may be used as the sole additive, or in combination with other additives such as tantalum carbide, vanadium carbide, niobium carbide, zirconium carbide, titanium carbide, and the like. The additional examples of carbides may also be used alone or in combination. The addition of a carbide material as a means for preventing excess grain growth is only one example embodiment. Other materials having similar characteristics might be used as a grain growth inhibitor.

Depending on the type of grain growth inhibitor used, the amount of the grain growth inhibitor combined with the base material may vary from one embodiment to the next. For example, in one embodiment hafnium carbide is combined with tungsten-rhenium alloy in an amount such that the hafnium carbide is about 0.10% to about 0.7% of the total weight of the target track material. The amount of hafnium carbide used may be more or less than the above range, depending on, for example, the composition of the base material. Depending on the type of grain growth inhibitor or combination of grain growth inhibitors used, the amount of grain growth inhibitor(s) may vary.

In an illustrated embodiment, the substrate 202 is made from a material(s) that can withstand the high operating temperatures of the x-ray generation process. Some examples of substrate materials include tungsten alloys and molybdenum alloys. In particular, some specific examples of substrate materials include, but are not limited to, TZM, Mo-FIfC, Mo—W, Mo—Re, and Mo—Nb. Furthermore, the substrate may be made from Mo-Lanthana, Mo-Ceria, Mo-Yttria, Mo-Thoria, or other combinations of these alloying elements. Any other suitable material(s) may likewise be employed for the substrate 202. The choice of substrate material may also be dictated by the particular application or tube type. For example, in a stationary anode tube, copper is often used as a substrate material.

The backing 206, if used, can be made from a variety of different materials. One purpose of the backing 206 material is to draw heat away from the substrate 202 and subsequently from the target track 204. Thus, the backing 206 material is preferably made from a material that exhibits good heat absorption characteristics and/or high heat capacity. For example, the backing 206 can be made from various carbon bearing materials, including graphite and graphite based composites. However, any other suitable material(s) may additionally or alternatively be employed in the construction of the backing 206.

In some applications, the backing material is comprised of a fluid, such as water, placed in thermal contact with the substrate material 202.

In an example embodiment, positioned between the backing 206 and the substrate 202 is a bond layer 208 that attaches the backing 206 to the substrate 202. The bond layer 208 can be made from a variety of materials that can chemically interact with both the backing 206 and substrate 202 materials. Some examples of bond layer 208 materials include zirconium, platinum, titanium, vanadium, and niobium. Other examples of bond layer 208 materials include alloys of zirconium, platinum titanium, vanadium, and niobium. Furthermore, a combination of one or more of zirconium, platinum, titanium, vanadium, and niobium, and/or a combination of their respective alloys, may be used in the bond layer 208. Any other suitable material(s) may likewise be employed for the bond layer 208.

Because some embodiments of the backing 206 comprise carbon, the bond layer 208 can also include a carbon management layer that may serve to retard, if not prevent, carbon diffusion out of the backing 206 and into one or more other layers of the substrate 202. In some embodiments, this carbon management layer takes the form of a carbide layer attached to the backing 206 surface to be attached to the substrate 202. The carbide layer may be made from a variety of carbide-based materials. Some examples of such materials include vanadium carbide, tantalum carbide, tungsten carbide, niobium carbide, hafnium carbide, and titanium carbide. Moreover, the carbide layer does not necessarily have to be a single material. Rather, multiple carbide materials may be used to make the carbide layer. For example, the carbide layer may be a combination of vanadium carbide and titanium carbide, or a combination of any of the other disclosed carbide-based materials. The foregoing is not an exhaustive list however, and any other suitable material(s) may be employed to form the carbon management layer.

Although the example embodiment of the x-ray target 106 shown in FIG. 2 includes four layers (i.e., the target track 204, the substrate 202, the bond layer 208, and the backing 206), the x-ray target 106 may include more or less than four layers. In one form, the target may include only two layers comprised of the target track and the substrate, as described above. In other embodiments the x-ray target might include additional bond layers. In another example, the target might include additional layers for various other purposes, such as heat dissipation, weight distribution, and/or mechanical connection to the x-ray device 100 (e.g., connecting to the shaft 110.)

In addition, it will be appreciated that the x-ray target 106 can be designed with a variety of different geometries from what is shown. For example, the thickness of the several layers of the x-ray target 106 can be varied depending on the needs of a particular application, and the operating characteristics desired. Generally, FIG. 2 illustrates one example of the thickness of each portion of the x-ray target 106 relative to other portions. However, there is no requirement that the relative thicknesses be configured in the manner illustrated, nor are they necessarily drawn to scale in the example illustrations. The relative thickness for each portion might differ from one embodiment to another, and within a single embodiment. For example, the backing 206, shown in FIG. 2, is relatively thicker than the substrate 202. However, in different embodiments the backing 206 may be made thinner than the substrate 202 if, for example, less heat capacity were required for a particular x-ray application.

In addition, FIG. 2 illustrates an example x-ray target 106 wherein each respective section has a substantially uniform thickness, except for the substrate 202, which is angled/tapered along its outer edge. In alternative embodiments, any one (or combination thereof) of these layers, including the backing 206, bond layer 208, and target track 204, might be configured with non-uniform thicknesses.

The thickness of the target track 204 may vary from one embodiment to the next depending on requirements of the x-ray device 100, such as x-ray power. In one embodiment, the target track thickness is about one millimeter. Other target track thicknesses may be thicker or thinner as required by a particular x-ray application.

The backing 206 and substrate 202 thicknesses may also vary depending, for example, on the requirements of the x-ray device 100 and the intended application. In some embodiments, the thickness of the backing 206 is a function of required heat capacity and/or weight requirements so that the more heat capacity required, the thicker the backing 206, but the lower the weight requirement, the thinner the backing 206. The thickness of the substrate 202 may likewise be determined based on design requirements. For example, the thickness of the substrate 202 may be based on the required x-ray power and/or application of the x-ray device 100. Relative thickness may also vary depending on the material used.

The bond layer 208 thickness may vary from one embodiment to the next, and within a single embodiment. The particular thickness employed can depend, for example, on the thickness required to create a suitable bond between the backing 206 and the substrate 202 that will withstand the heat and forces produced by the x-ray generation process. Some example thicknesses of the bond layer 208 range from about 5 microns to about 50 microns. The bond layer 208 thickness may be thinner or thicker than the ranges described above depending, for example, on the thickness and diameters of the backing 206 and substrate 202, and/or other variables.

Other geometric attributes of the example x-ray target 106 may also vary from what is illustrated in the example embodiment. By way of example, the respective cross-sectional dimensions of each component may vary from one embodiment to another, and within a single embodiment. In one embodiment, where the x-ray target 106 has a substantially cylindrical configuration, the backing 206 and substrate 202 may have a variety of diameters depending, for example, on the x-ray generation power requirements and/or application of the x-ray device 100. Some examples of outside diameters of the backing 206 and substrate 202 range from about one inch to about ten inches, but can be bigger or smaller depending on the x-ray generation power required and/or the application of the x-ray device 100 where the x-ray target 106 is used.

The cross-sectional dimension for each example layer may vary from one embodiment to another such that any given layer may have a cross-sectional dimension different from that of any other layer. FIG. 2 illustrates one example of an x-ray target 106 where the cross-sectional dimension of the substrate 202, bond layer 208 and backing 206 are substantially equal. Alternatively, for example, the backing 206 may have a different diameter than the bond layer 208 and/or the substrate 202.

The extent to which each layer contacts or otherwise interfaces with adjacent layer(s) is another example of how the geometric configuration of the x-ray target 106 may vary. FIG. 2 illustrates, for example, one embodiment of an x-ray target where layers of the example x-ray target 106 are substantially coextensive with the respective surfaces of one or more adjacent layers. In contrast, however, the example target track 204 extends over only a portion of the surface of the substrate 202. In an alternative example, the bond layer 208 may cover only a portion of the surface of the backing 206, while being substantially co-extensive with the substrate 202. Also, the target track 204 may substantially cover the upper surface 202A of the substrate 202.

The shape of the each layer of the x-ray target 106 may vary from one embodiment to the next or from one layer to the next within the same embodiment. For example, FIG. 2 illustrates one embodiment where the target track 204 has a substantially annular configuration. The inside and outside diameters of the target track 204 may vary depending, for example, on the design of the x-ray device 100 and placement of the cathode 104 within the x-ray device 100 with respect to the target track 204. As a further example, the backing 206 and the substrate 202 may each have a substantially cylindrical shape, while the bond layer 208 may have a substantially annular shape.

Varying geometric attributes such as the thickness, diameter, size and shape of one or more of the example layers of the example x-ray target 106 may be employed to desirably achieve a particular geometric configuration for the overall x-ray target 106. One example of an overall geometric configuration of the example x-ray target 106 is illustrated in FIG. 2. As illustrated in FIG. 2, the x-ray target 106 has a substrate 202, which is cylindrical with a trapezoidal cross-section, attached to a cylindrical backing 206. However, the overall shape of the x-ray target 106 may take any other suitable form as well, and the scope of the invention is not limited to past x-ray target geometries.

As briefly mentioned above, example embodiments of the x-ray target 106 may be configured to be attached or coupled to the shaft 110 such that a rotational motion can be imparted to the x-ray target 106. For example, a rotating x-ray target 106 may include forming or creating a substantially circular hole in the backing 206 where the shaft 110 may be inserted. The shaft 110 may be attached to the backing 206 in a variety of ways including, but not limited to, brazing, welding, diffusion bonding, inertia welding, slip tolerance fit, through the use of mechanical fasteners such as bolts or screws and/or any combination of the foregoing. Furthermore, the hole created in the backing 206 may extend through any layer, or all layers of the x-ray target 106.

3. Example Method of Making an X-Ray Target

Figure 3:
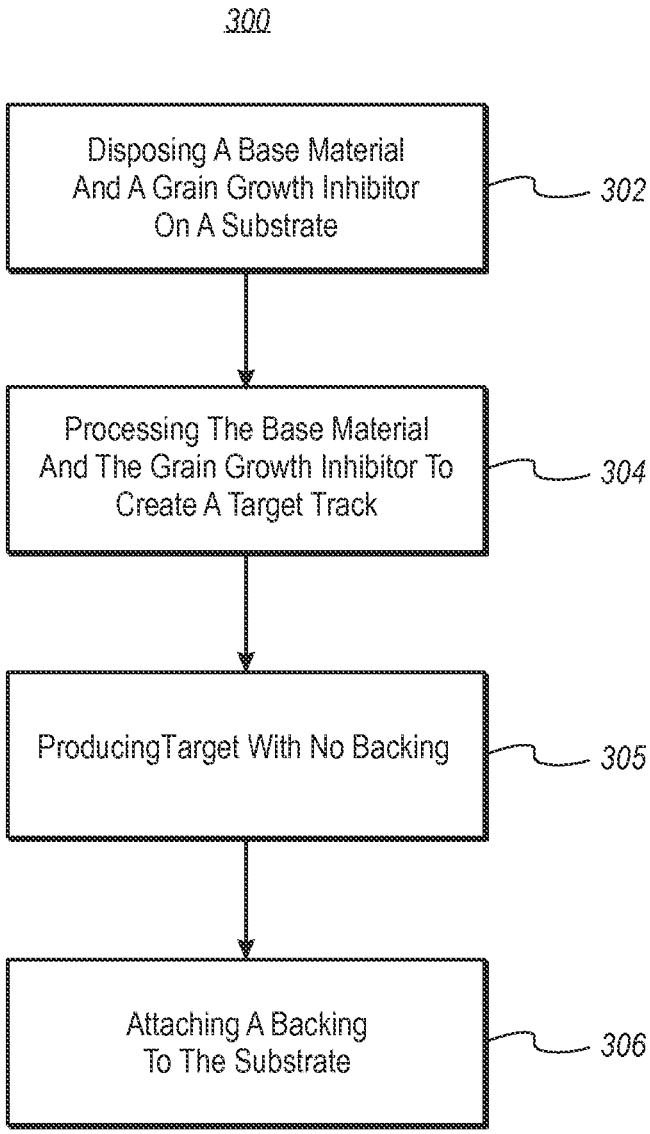
FIG. 3 illustrates a flow diagram of an example method of making an x-ray target.

FIG. 3 illustrates aspects of an example method 300 for creating an x-ray target. In one example method, a target track is disposed 302 on a substrate, the target track material including a base material and grain growth inhibitor(s). The target track may then be processed 304 such that the density of the target track is increased. The grain growth inhibitor prevents excessive microstructure grain growth during processing 304, and results in a target with no backing 305. A backing may then be attached 306 to the substrate. The disposing 302, processing 304/305, and attaching 306 can each be performed using a variety of techniques, examples of which will be discussed.

In one embodiment, the target track is disposed 302 on the substrate using a Vacuum Plasma Spray ("VPS") process. In this example process, feedstock powder of the base material(s) and the grain growth inhibitor are combined and prepared to contain the desired amount of each material component. In one example, the VPS combined feedstock powder contains about 90% tungsten, about 10% rhenium, and about 0.15% hafnium carbide, by weight. In other embodiments, the VPS combined feedstock powder may contain various amounts of each of the components that will make up the target track material, as discussed above. Generally, if the base material is a tungsten alloy and the additive is hafnium carbide, the amount of hafnium carbide added may range from about 0.1% to about 0.7% by total weight. The additive weight percentage may be higher or lower in other embodiments.

Prior to VPS forming, the combined feedstock powder may be processed using a Plasma Alloying and Spherodization technique (e.g., Power Alloying & Spheroidization$^{SM}$ (PAS$^{SM}$) powder from Plasma Processes, Inc., Huntsville, Ala.), and may also be sieved to obtain a specific particle size. Example particle sizes may be about 0.5 μm or smaller, however, larger size particles may be used as well. The prepared feedstock powder can then be VPS formed onto the substrate by way of a plasma spray system to form the target track.

For example, the VPS forming of the target track can be performed in a controlled atmosphere chamber using, for example, a 120 KW plasma spray system having high efficiency nozzles, such as those disclosed in U.S. Pat. No. 5,573,682, which is incorporated by reference herein. The plasma gun and part manipulation can be computer numerically controlled, or other appropriate techniques as know by those of skill in the art can be used. Prior to spraying, the vacuum chamber can be evacuated and backfilled with, for example, a partial pressure of argon. During spraying, powder can be delivered to the plasma gun by an argon carrier gas (or suitable substitute), and an argon-hydrogen plasma can be used to melt the powder and accelerate it towards, for example, a rotating mandrel upon which is supported the target substrate. The various powders are then deposited to an appropriate target thickness. After VPS forming, the target track can be further heat treated. For example, a two step process might be used where the VPS formed track is first hydrogen sintered and then HIPed. The post-spray heat treatment can be performed to improve consolidation and refine the microstructures.

VPS is only one of many methods that may be used to dispose the target track on the substrate. Other example methods include, but are not limited to, powder metallurgy (P/M), electroplating, metal hydride coating process, chemical vapor deposition (CVD), physical vapor deposition (PVD), electrodeposition, friction-stir welding, solid-state diffusion bonding of track pre-form (e.g. W—Re—HfC), or any other method where the target track material chemically interacts with the substrate and provides a way to include the grain growth inhibitor to prevent microstructure grain growth in the base material.

After disposing the target track on the substrate 302, the target track may be processed in order to increase the density of the target track material, as is denoted at step 304. One example of processing 304 is to heat treat the target track. In one implementation of this example process, the target track is placed in a high vacuum furnace at a temperature of about 1,700 degrees Celsius to about 1,800 degrees Celsius for a period of about four to twelve hours. The time, temperature and pressure may vary and be any combination that allows for the desired target track densification.

Other example methods of processing 304 include, but are not limited to, placing the target track under high pressure and temperature, such as using a hot isostatic (HIP) press with argon gas, or any other method that allows for the densification of the target track, such as cold or hot forging.

Processing the target track may lead to varied densities of the target track. In one example embodiment, the target track may have a density of about 98% or higher. However, in other embodiments the density may be higher or lower.

As the density of the target track material increases during processing, the grain growth inhibitor may prevent excess grain growth in the microstructure of the base material. With the prevention of excess grain growth in the microstructure, the target track material may be stronger at high operating temperatures, relative to other target track materials that do not include a similarly functioning grain growth inhibitor.

Upon finalization of the target at step 305, a backing is optionally attached to the substrate, a denoted at step 306. There are a variety of methods that may be used to attach 306 the backing to the substrate. In one embodiment, the backing is attached 306 with a bond layer that is formed between the backing and the substrate, the bond layer configured to chemically interact with both the backing and substrate in a way that couples the backing and substrate together. For example, the bond layer may be formed by performing a braze process using a braze material that is secured between the backing and the substrate. During the brazing process, the braze material becomes molten and chemically interacts with the backing and substrate to form a bond.

There are several aspects of the brazing process that may vary from one embodiment to the next. For example, the time, temperature and pressure of the braze process may vary.

The times, pressures and/or temperatures of the braze process often depend on the type of braze material used. Some example braze materials include zirconium, titanium, platinum, or any alloys of zirconium, titanium or platinum with a minute amount of alloying element(s), such as Mo, W, Ta, Nb, Hf, or Re. In one example braze process, the braze material comprises a zirconium washer that is secured between the substrate and backing. For example, the backing and substrate are brazed with a zirconium washer at a temperature in the range of about 1,560 degrees Celsius to about 1,590 degrees Celsius for about five to ten minutes in a vacuum furnace. Of course, various other times, pressures and/or temperatures may alternatively be employed.

In another embodiment, several washers may be employed, with each washer being made from a different material, and used in combination with the above braze process to form the bond layer. For example, a three layer washer assembly might be comprised of V, Ta, and Zr.

The use of a washer is not the only method to arrange the braze material between the substrate and backing. In another example, a hydride paste containing the braze material may be placed between the substrate and backing. For example, zirconium hydride paste may be placed between the backing and the substrate. Moreover, any other method that arranges the braze material between the backing and the substrate may also be used. The above brazing process, or any other suitable braze process, is then performed to form the bond layer and attach or couple the substrate to the backing.

The bond layer may also be formed by employing the above brazing process in combination with a carbon management layer. For example, because the backing may be made from a graphite composite material, it may be desirable to form a carbon management layer on the backing that retards the diffusion of carbon from the backing into the braze material. After the carbon management layer is formed, the above brazing process, or any other suitable process, is then performed to form a multiple layer bond that may have a reduced interface stress between the backing and substrate relative to bond layer without a carbon management layer.

One way to form the carbon management layer is to coat the backing with a carbide forming metal and then process the carbide forming metal coat to form the carbon management layer. There are various carbide forming metals that may be used to coat the backing, such as vanadium, tantalum, tungsten, niobium, hafnium, and titanium. These example carbide forming metals may be used alone or in combination with one another. In one embodiment, the carbide forming metal coating deposited on the backing is pure or substantially pure metal.

There are a variety of ways to coat the backing with a carbide forming metal. For example, a chemical vapor deposition process may be used to coat the backing. In this example process, a metal hydride of a carbide forming metal is first deposited on the substrate. The metal hydride decomposes to form a carbide forming metal coat on the substrate. Other example coating methods may also be used, such as electrodeposition, electroplating, vacuum sputtering, melt evaporation, or any combination of the above processes.

The above coating processes may coat the backing with various thicknesses of carbide forming metal. One example embodiment of the carbide forming metal coat has a thickness in a range of about five to fifty microns. However, the thickness of the carbide forming metal coat may be any thickness that allows for the creation of the carbon management layer sufficient to retard carbon diffusion from the backing while attaching the backing to the substrate 306. The carbide forming metal coat thickness may be deposited as a single coat or alternatively, may be formed by the deposition of multiple coats of various materials on the backing.

Subsequent to coating the backing with the carbide forming metal, the coating is processed to form the carbon management layer. One example of processing is a vacuum outgassing process. In one specific implementation of this example process, the carbide forming metal coated backing is placed in a high vacuum furnace with a temperature greater than about 1,600 degrees Celsius. The carbide forming metal coated backing is outgassed for a period necessary for the carbide forming metal coat on the backing to form the carbon management layer. An example outgas period for the carbide forming metal coat to form the carbide layer can range from about one-half hour to about four hours for the temperature noted above. Time and temperature of the outgassing process may vary.

During the outgassing process, the carbide forming metal coat on the backing forms a carbon diffusion barrier layer on the substrate that retards carbon diffusion from the backing to the substrate during the attaching 306 process, which effectively reduces the interface stress in the bond between the substrate and the backing. After the carbide diffusion barrier layer is formed, the above brazing process, or any other suitable process, is then performed to form a multiple layer bond (i.e., x-ray target).

In contrast to the above described bonding processes, the attaching 306 process does not necessarily have to implement the use of a bond layer. Instead, other attaching methods may be used such as mechanical fasteners, structural retaining devices that hold the backing and substrate together, or any other suitable methods that may be used to attach the backing to the substrate and thereby provide continuous thermal conduction.

In summary, an x-ray target constructed with an x-ray target track of the type described provides a number of advantages over existing targets. In particular, the target track exhibits superior thermal characteristics and is able to withstand higher operating temperatures and can thus be used in high power x-ray tubes and applications. Moreover, the need for larger target tracks and/or additional thermal backing is minimized, thereby allowing for an overall smaller x-ray target. This results in a target that is easier to rotate at operational speeds, takes up less space, requires less materials and is lower in cost, among other advantages. Moreover, there is no sacrifice in operating efficiency.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A method for manufacturing an x-ray target, the method comprising:

combining a base material and a grain growth inhibitor material;

depositing the combined base material and grain growth inhibitor material onto a substrate; and processing the combined base material and the grain growth inhibitor material to form a target track material by heat treating the target track material in a vacuum furnace at a temperature of 1,700 degrees Celsius for a period of about four to twelve hours to increase the density of the target track material.

2. The method as recited in claim 1, wherein the combining comprises combining the base material and the grain growth inhibitor material in a feedstock powder form before depositing the feedstock powder on the substrate.

3. The method as recited in claim 2, further comprising processing the feedstock powder to achieve a feedstock particle size of about 0.5 μm or smaller.

4. The method as recited in claim 1, wherein the combining comprises combining the base material and the grain growth inhibitor material in a feedstock powder form and depositing comprises a Vacuum Plasma Spray (VPS) process.

5. The method as recited in claim 1, further comprising placing a backing in thermal communication with the substrate,

6. The method as recited in claim 1, further comprising affixing a backing to the substrate with a bond layer.

7. The method as recited in claim 6, wherein the bond layer is formed with a braze process.

8. The method as recited in claim 7, wherein the braze process comprises:

placing one or more washers between the substrate and the backing;

heating the one or more washers for a predetermined time and at a predetermined temperature so as to form a braze bond layer.

9. The method as recited in claim 7, wherein the braze process comprises:

placing a hydride paste containing a braze material between the substrate and the backing

10. The method as recited in claim 6, wherein the bond layer is formed with a carbon management layer.

11. The method as recited in claim 10, wherein the carbon management layer is formed by:

coating the backing with a carbide forming metal to a predetermined thickness that is sufficient to retard carbon diffusion from the backing; and processing the coating to form the carbon management layer.

12. The method as recited in claim 11, wherein the processing of the coating comprises a vacuum outgassing process.

13. The method as recited in claim 1, wherein the depositing comprises depositing the combined base material and grain growth inhibitor material onto the substrate as a single layer.

14. A method for manufacturing an x-ray target, the method comprising:

combining a base material and a grain growth inhibitor material;

depositing the combined base material and grain growth inhibitor material onto a substrate;

processing the combined base material and the grain growth inhibitor material to form a target track material; and affixing a backing to the substrate with a bond layer, the bond layer formed with a braze process by placing a hydride paste containing a braze material between the substrate and the backing.

15. The method as recited in claim 14, wherein the base material and the grain growth inhibitor material are combined in a feedstock powder form before depositing the feedstock powder on the substrate.

16. The method as recited in claim 15, further comprising processing the feedstock powder to achieve a feedstock particle size of about 0.5 μm or smaller.

17. The method as recited in claim 14, wherein the base material and the grain growth inhibitor material are combined in a feedstock powder form and then deposited onto a substrate with a Vacuum Plasma Spray (VPS) process.

18. A method for manufacturing an x-ray target, the method comprising:

combining a base material and a grain growth inhibitor material;

depositing the combined base material and grain growth inhibitor material onto a substrate;

processing the combined base material and the grain growth inhibitor material to form a target track material; and affixing a backing to the substrate with a bond layer, the bond layer formed with a carbon management layer and wherein the carbon management layer is formed by:

coating the backing with a carbide forming metal to a predetermined thickness that is sufficient to retard carbon diffusion from the backing; and processing the coating to form the carbon management layer with a vacuum outgassing process.

* * * * *

UNITED STATES PATENT AND TRADEMARK OFFICE

CERTIFICATE OF CORRECTION

PATENT NO. : 8,509,386 B2
APPLICATION NO. : 12/816216
DATED : August 13, 2013
INVENTOR(S) : Lee et al.

It is certified that error appears in the above-identified patent and that said Letters Patent is hereby corrected as shown below:

In the Specification:

In Column 3, Line 34, delete "with a" and insert -- with an --, therefor.

In Column 5, Line 56, delete "Mo-FIfC," and insert -- Mo-HfC, --, therefor.

In the Claims:

In Column 12, Lines 42-43, in Claim 5, delete "substrate," and insert -- substrate. --, therefor.

In Column 12, Line 58, in Claim 9, delete "backing" and insert -- backing. --, therefor.

Signed and Sealed this
Twelfth Day of November, 2013

Teresa Stanek Rea

Teresa Stanek Rea
*Deputy Director of the United States Patent and Trademark Office*